US009829861B2

(12) United States Patent
Egli et al.

(10) Patent No.: US 9,829,861 B2
(45) Date of Patent: Nov. 28, 2017

(54) FLEXIBLE BEARING FOR PIVOTING A MOBILE TIMEPIECE ELEMENT

(71) Applicant: ETA SA Manufacture Horlogere Suisse, Grenchen (CH)

(72) Inventors: Roman Egli, Oensingen (CH); Matthaus Friedli, Solothurn (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 15/244,101

(22) Filed: Aug. 23, 2016

(65) Prior Publication Data

US 2017/0115637 A1 Apr. 27, 2017

(30) Foreign Application Priority Data

Oct. 26, 2015 (EP) ..... 15191369

(51) Int. Cl.

| | |
|---|---|
| ***G04B 31/00*** | (2006.01) |
| ***G04C 3/00*** | (2006.01) |
| ***G04F 7/08*** | (2006.01) |
| ***G04B 31/008*** | (2006.01) |
| ***G04B 35/00*** | (2006.01) |

(52) U.S. Cl.

CPC ..... *G04C 3/008* (2013.01); *G04B 31/00* (2013.01); *G04B 31/008* (2013.01); *G04B 35/00* (2013.01); *G04F 7/0804* (2013.01)

(58) Field of Classification Search

CPC ..... G04B 31/02; G04B 31/04; G04B 31/00; G04B 31/008; G04B 35/00; G04F 7/0804; G04C 3/008

See application file for complete search history.

(56) References Cited

U.S. PATENT DOCUMENTS 2,455,081 A * 11/1948 Morf ..... G04B 31/04 368/326
2,538,142 A * 1/1951 Zurcher ..... G04B 31/04 368/326
2,919,961 A * 1/1960 Matthey ..... G04B 31/02 384/225

(Continued)

FOREIGN PATENT DOCUMENTS

| | | |
|---|---|---|
| CH | 707 809 A2 | 9/2014 |
| EP | 2 757 426 A1 | 7/2014 |

OTHER PUBLICATIONS

European Search Report (with Written Opinion) dated Apr. 14, 2016 in European Application 15191369.6 filed Oct. 26, 2015 (with English translation of Categories of Cited Documents).

*Primary Examiner* — Sean Kayes
(74) *Attorney, Agent, or Firm* — Oblon, McClelland, Maier & Neustadt, L.L.P.

(57) ABSTRACT

Elementary timepiece mechanism comprising a first housing about an axis, a second housing, and a mobile element comprising a first shoulder pivoting in the first housing and a second shoulder pivoting in the second housing, the second housing comprising at least a first abutment surface arranged to ensure the alignment of the mobile element on said axis when the mobile element is in abutment on the first abutment surface, and the elementary mechanism includes at least one elastic return means arranged to return the mobile element to this first abutment surface.

11 Claims, 1 Drawing Sheet

(56) References Cited

U.S. PATENT DOCUMENTS

| | | | | |
|---|---|---|---|---|
| 4,143,511 | A * | 3/1979 | Bachmann | G04B 31/04<br>368/326 |
| 9,625,880 | B2 * | 4/2017 | Girardin | G04B 31/02 |
| 9,684,283 | B2 * | 6/2017 | Stranczl | G04B 31/06 |

* cited by examiner

FLEXIBLE BEARING FOR PIVOTING A MOBILE TIMEPIECE ELEMENT

This application claims priority from European Patent Application No 15191369.6 filed Oct. 26, 2015 the entire disclosure of which is hereby incorporated herein by reference.

FIELD OF THE INVENTION

The invention concerns an elementary timepiece mechanism comprising a first structure element carrying a first housing about a theoretical pivot axis, a second structure element carrying a second housing, and a mobile element which comprises, at a first end, a first shoulder arranged to pivot in said first housing and at a second end, a second shoulder arranged to pivot in said second housing, wherein said second housing comprises at least a first abutment surface which is arranged to ensure the alignment of said mobile element on said theoretical pivot axis when said mobile element is in abutment on said first abutment surface, wherein said elementary mechanism comprises at least one elastic return means arranged to return said mobile element to said first abutment surface.

The invention also concerns a chronograph mechanism including at least one such elementary mechanism.

The invention also concerns a watch including such a chronograph mechanism and/or including at least one such elementary mechanism.

The invention concerns the field of timepiece mechanisms, and in particular, mechanisms concerning wheel sets which need to be returned and/or held in position by means other than toothings.

BACKGROUND OF THE INVENTION

Some timepiece mechanisms, notably but not restricted to chronograph mechanisms, comprise mobile elements associated with cams, in particular heart-pieces, which cooperate with the pane of a hammer to achieve a return to a given position (return to zero), and/or holding in said particular position. These hammers are often made to be flexible, or in several articulated parts, or the mechanism requires a positioning spring.

EP Patent 275746 in the name of MONTRES BREGUET S A discloses a device for pivoting an arbor of a timepiece movement wherein a pivot passes through a jewel fixed in a setting, and an endstone comprising a bearing surface receiving the end of the pivot, and, in the stop position of the pivot on the endstone, the normal to the tangent plane common to the pivot and to the bearing surface is oblique with respect to the axis at an angle of cant, and defines with the axis an endstone plane oriented at a yaw angle with respect to a reference of a plate of the movement. This device includes means for adjusting the yaw angle and/or the angle of cant in order to regulate and adjust the rate of the movement.

SUMMARY OF THE INVENTION

The invention proposes to ensure the precise positioning of a chronograph counter when it returns to zero, without requiring a flexible hammer or multi components, or a positioning spring.

To this end, the invention concerns an elementary timepiece mechanism comprising a first structure element carrying a first housing about a theoretical pivot axis, a second structure element carrying a second housing, and a mobile element which comprises, at a first end, a first shoulder arranged to pivot in said first housing and at a second end, a second shoulder arranged to pivot in said second housing, wherein said second housing comprises at least a first abutment surface which is arranged to ensure the alignment of said mobile element on said theoretical pivot axis when said mobile element is in abutment on said first abutment surface, wherein said elementary mechanism comprises at least one elastic return means arranged to return said mobile element to said first abutment surface, characterized in that said mobile element comprises an eccentric heart-piece with respect to the axis of said first shoulder of said mobile element.

The invention also concerns a chronograph mechanism including at least one such elementary mechanism.

The invention also concerns a watch including such a chronograph mechanism and/or including at least one such elementary mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

The invention concerns a monolithic articulated structure or flexible bearing for pivoting a mobile timepiece element, in a timepiece mechanism.

Figure 1:
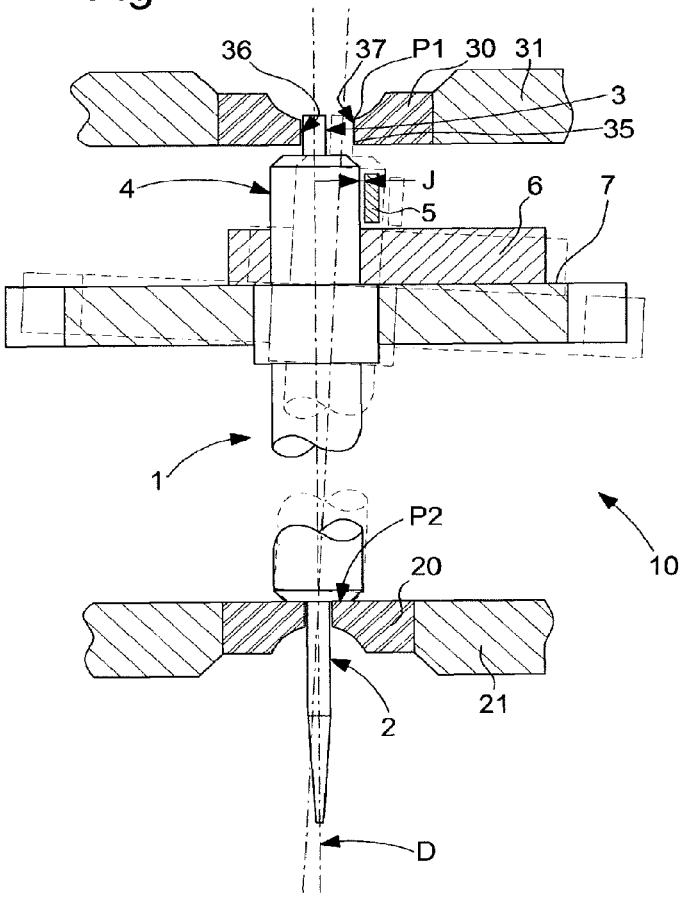
FIG. 1 represents a schematic view of an elementary mechanism according to the invention, in cross-section through the theoretical pivot axis of the mobile element comprised therein, in a first position in solid lines in which the mobile element is aligned on its theoretical pivot axis, and a second position in dotted dotted lines wherein the mobile element is tilted.

The invention more particularly concerns an elementary timepiece mechanism 10, which includes, as seen in FIG. 1:

- a first structure element 21 carrying a first housing 20, about a theoretical pivot axis D,
- a second structure element 31, carrying a second housing 30,
- and a mobile element 1, which comprises, at a first end, a first shoulder 2 arranged to pivot in first housing 20 and at a second end, a second shoulder 3 arranged to pivot in second housing 30.

This first housing 20 and second housing 30 may consist of bearings, which may or may not be added, jewels or suchlike, bores machined in first structure element 21 and/or second structure element 31, or even simple orifices made in first structure element 21 and/or second structure element 31.

First housing 20, in a particular variant illustrated by the Figures, is a housing with rotational symmetry; in this particular case it is preferably coaxial to theoretical pivot axis D. First housing 20 could also have a different shape, notably non-circular, for example oblong, or another shape.

Second housing 30 comprises at least a first abutment surface 36.

In a particular and non-limiting variant, illustrated by the Figures, the second housing comprises a second abutment surface 37, which is at a different distance from theoretical pivot axis D, with respect to first abutment surface 36.

However, second housing 30 is not necessarily closed, it may, for example, consist of a simple notch, open on one side.

First abutment surface 36 is arranged to ensure the alignment of mobile element 1 on theoretical pivot axis D, when mobile element 1 is in abutment on first abutment surface 36.

Elementary mechanism 10 comprises at least one elastic return means 5, which is arranged to return mobile element 1 to first abutment surface 36.

When second housing 30 comprises a second abutment surface 37, the latter corresponds to a tilted position of mobile element 1 with respect to theoretical pivot axis D, when mobile element 1 is in abutment on second abutment surface 37. Mobile element 1 is then tilted, and bears at P1 on second housing 30, and at P2 on first housing 20.

Second housing 30 is arranged to guide second shoulder 30, preferably but not restricted to, along a rectilinear trajectory corresponding to a plane trajectory of the pivot axis of mobile element 1.

Figure 2:
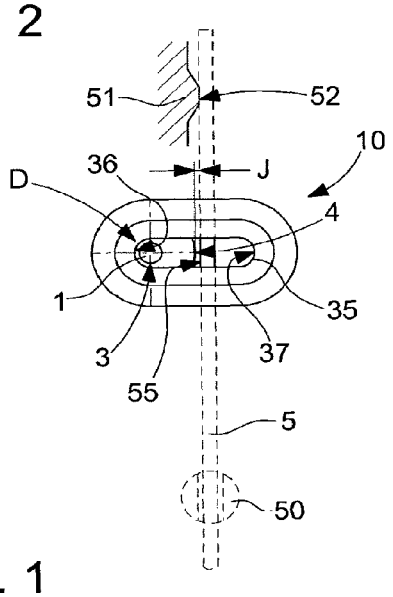
FIG. 2 shows a top view of the mechanism of FIG. 1, in the first position.
Figure 3:
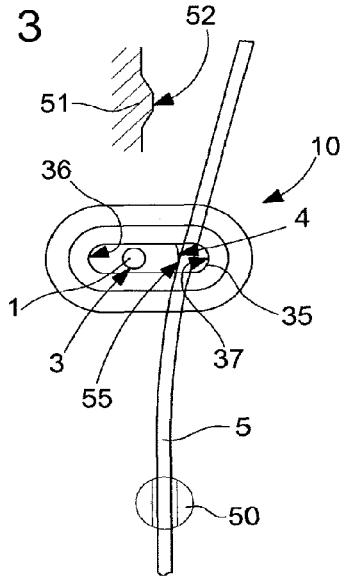
FIG. 3 shows a top view of the mechanism of FIG. 1, in the second position.

In a particular non-limiting embodiment, and as seen in FIGS. 2 and 3, said second housing 30 is oblong with parallel sides.

It is understood that the second end 3 of mobile element 1 moves in this second housing 30, whose oblong has a very different function to those known elsewhere (to facilitate the assembly and initial setting of a tourbillon, of an escapement, or other element, prior to immobilisation in a suitable position) In the context of the invention, the arbor of mobile element 1 pivots about first housing 2, preferably in a plane defined by such an oblong.

More specifically, first structure element 21, or second structure element 31, or as illustrated in FIGS. 2 and 3, a third structure element 50, carries such an elastic return means 5, which is arranged to return mobile element 1 to first abutment surface 36, and thus towards its theoretical pivot axis.

First structure element 21, or second structure element 31, or third structure element 50, or as illustrated in FIGS. 2 and 3, a fourth structure element 51, comprises an abutment surface 52, which is arranged to act as a stop for elastic return means 5, in a position in which second shoulder 3 of mobile element 1 is movable between first abutment surface 36 and a remote position, which corresponds to the abutment of mobile element 1 on a bearing surface 55 of elastic return means 5.

In the particular and non-limiting embodiment of the Figures, elastic return means 5 cooperates with a third shoulder 4 of mobile element 1, which is distinct from first shoulder 2 and from second shoulder 3.

This elastic return means 5 is arranged to exert a force on mobile element 1 substantially perpendicularly to theoretical pivot axis D. In a simple embodiment, it is formed by a flexible strip, which may be in one-piece with first structure element 21, and/or second structure element 31, and/or third structure element 50, and/or fourth structure element 51.

In a variant, first housing 20 and second housing 30 are both oblongs or similar; the resulting force exerted by elastic return means 5 on mobile element 1 is then, preferably, applied in a median area of mobile element 1, between first housing 20 and second housing 30. Preferably, first housing 20 and second housing 30 are oblongs that are parallel to each other.

According to the invention, in a particular application illustrated by FIG. 1, mobile element 1 comprises an eccentric heart-piece with respect to the axis of first shoulder 2 of mobile element 1.

In a particular embodiment, depending on its function, mobile element 1 comprises drive means 7.

Naturally, the function of settings 20 and 30 may be switched.

The invention also concerns a timepiece mechanism comprising several mobile elements, and comprising at least one such elementary mechanism 10.

More specifically, the invention concerns a chronograph mechanism 200 including at least one such elementary mechanism 10.

The invention also concerns a watch 100 including such a chronograph mechanism 200 and/or including at least one such elementary mechanism 10.

The invention makes it possible to ensure compensation with backlash take-up.

It permits a reduction in the production cost of mechanisms, as a result of the possibility of increasing manufacturing tolerances.

The invention also permits the use of one-piece hammers, with no subsequent correction operations

What is claimed is:

1. An elementary timepiece mechanism comprising a first structure element carrying a first housing about a theoretical pivot axis, a second structure element carrying a second housing, and a mobile element which comprises, at a first end, a first shoulder arranged to pivot in said first housing and at a second end, a second shoulder arranged to pivot in said second housing, wherein said second housing comprises at least a first abutment surface which is arranged to ensure the alignment of said mobile element on said theoretical pivot axis when said mobile element is in abutment on said first abutment surface, wherein said elementary mechanism comprises at least one elastic return means arranged to return said mobile element to said first abutment surface, wherein said mobile element comprises an eccentric heart-piece with respect to the axis of said first shoulder of said mobile element.

2. The elementary mechanism according to claim 1, wherein said elementary mechanism comprises a third structure element carrying a said elastic return means arranged to return said mobile element to said first abutment surface, and wherein said elementary mechanism comprises a fourth structure element comprising an abutment surface arranged to act as a stop for said elastic return means, allowing play between said mobile element and said elastic return means, when said second shoulder of said mobile element is in abutment on said first abutment surface.

3. The elementary mechanism according to claim 1, wherein said first housing is with rotational symmetry about said theoretical pivot axis.

4. The elementary mechanism according to claim 1, wherein said second housing comprises at least one said first abutment surface, and a second abutment surface, which are at different distances from said theoretical pivot axis, and said second abutment surface corresponds to a tilted position of said mobile element with respect to said theoretical pivot axis when said mobile element is in abutment on said second abutment surface.

5. The elementary mechanism according to claim 1, wherein said second housing is arranged to guide said second shoulder on a rectilinear trajectory corresponding to a plane trajectory of the pivot axis of said mobile element.

6. The elementary mechanism according to claim 1, wherein said second housing is oblong with parallel sides.

7. The elementary mechanism according to claim 1, wherein said elastic return means cooperates with a third shoulder of said mobile element which is distinct from said first shoulder and from said second shoulder.

8. The elementary mechanism according to claim 1, wherein said elastic return means is arranged to exert a force on said mobile element substantially perpendicularly to said theoretical pivot axis.

9. The elementary assembly according to claim 1, wherein said mobile element comprises drive means.

10. A chronograph mechanism including at least one elementary mechanism according to claim 1.

11. A watch comprising a chronograph mechanism according to claim 10.

* * * * *